US009587333B1

(12) United States Patent
Ellsworth

(10) Patent No.: US 9,587,333 B1
(45) Date of Patent: Mar. 7, 2017

(54) ROPER'S GLOVE

(71) Applicant: Noble Rider, LLC, Modesto, CA (US)

(72) Inventor: Chris Ellsworth, Modesto, CA (US)

(73) Assignee: Noble Rider, LLC, Modesto, CA (US)

( * ) Notice: Subject to any disclaimer, the term of this patent is extended or adjusted under 35 U.S.C. 154(b) by 116 days.

(21) Appl. No.: 14/634,536

(22) Filed: Feb. 27, 2015

Related U.S. Application Data

(60) Provisional application No. 61/946,291, filed on Feb. 28, 2014.

(51) Int. Cl.
*D04B 1/28* (2006.01)
*A41D 19/015* (2006.01)

(52) U.S. Cl.
CPC ..... *D04B 1/28* (2013.01); *A41D 19/01547* (2013.01)

(58) Field of Classification Search
CPC ..... D04B 7/34; D04B 1/28; D04B 9/58
See application file for complete search history.

(56) References Cited

U.S. PATENT DOCUMENTS 5,323,490 A * 6/1994 Yarbrough ..... A41D 19/0062 2/161.7
6,155,084 A * 12/2000 Andrews ..... A41D 13/08 2/16
6,253,382 B1 * 7/2001 Kleinert ..... A41D 19/015 2/16
6,782,720 B2 * 8/2004 Vero ..... A41D 19/01505 2/161.6
6,945,080 B2 * 9/2005 Maeda ..... A41D 19/00 2/169
7,434,422 B2 * 10/2008 Thompson ..... A41D 19/00 2/159
7,555,921 B2 * 7/2009 Thompson ..... A41D 19/0096 2/159
7,694,351 B2 * 4/2010 Gait ..... A41D 19/01523 2/161.1
7,707,653 B2 * 5/2010 Kleinert ..... A41D 19/015 2/161.1
7,908,891 B2 * 3/2011 Thompson ..... A41D 19/0065 66/174
8,001,809 B2 * 8/2011 Thompson ..... A41D 19/0065 2/161.6
2008/0072358 A1 * 3/2008 Kleinert ..... A41D 19/015 2/21
2010/0275341 A1 * 11/2010 Sweeney ..... A41D 19/01505 2/164
2012/0204604 A1 * 8/2012 Azeem ..... D04B 1/28 66/174
2013/0205469 A1 * 8/2013 Thompson ..... A41D 19/015 2/163

* cited by examiner

*Primary Examiner* — Danny Worrell
(74) *Attorney, Agent, or Firm* — Thomas M. Freiburger

(57) ABSTRACT

A roper's glove is of knitted construction and designed to reduce bulk in the knuckles so as to allow a high degree of flexibility and a full range of motion in gripping and handling a rope. Most of the glove is of normal knit construction, but across knuckles the knitting courses are formed of a substantially lighter and less bulky feeder yarn to provide flexibility. Preferably about five such courses comprising the lighter feeder yarn are included at each knuckle, separated by several normal knitting courses. With reduced bulk in the knuckles, when the hand is closed around a rope the user has better contact with the rope for enhanced feel and control.

12 Claims, 3 Drawing Sheets

ROPER'S GLOVE

This application claims benefit from provisional application No. 61/946,291, filed Feb. 28, 2014.

BACKGROUND OF THE INVENTION

This invention concerns workers' gloves, and especially gloves used by ropers, for roping cattle.

Ropers' gloves need to be fairly heavy, to protect the hands. Many available gloves are heavy, thick and protective, but they are accordingly stiff at the knuckles and wrist, therefore not providing sufficient flexibility for the roper comfortably and efficiently to handle a rope during roping operations.

Ropers' gloves have included knit construction, typically made with the same construction from the tip of the fingers to the end of the palm, where a rib construction usually begins for the cuff that surrounds the wrist. This construction produces a glove that is not sufficiently flexible at the knuckles and other joints of the hand.

There is a need for a roper's glove that adequately protects the hands while allowing sufficient flexibility and comfort at the joints or for full and easy range of motion.

SUMMARY OF THE INVENTION

The invention is a roper's glove of knitted construction, designed to reduce bulk in the knuckles so as to allow a high degree of flexibility and a full range of motion in gripping and handling the rope. The primary use of the gloves of the invention is in competitive rodeo events such as team roping or calf roping. In the invention a modified knit construction is specifically engineered into the knuckles of the fingers and across the palm where bending occurs, to reduce bulk at these joints. By reducing bulk in the knuckles, when the hand is closed around the rope the user has better contact with the rope for enhanced feel and control, attributes needed in performance gloves used for competitive roping.

The invention improves flexibility in a roper's glove, and comfort and gripping feel and efficiency, without compromising strength of the glove. These and other objects, advantages and features of the invention will be apparent from the following description of a preferred embodiment, considered along with the accompanying drawings.

DESCRIPTION OF PREFERRED EMBODIMENTS

Figure 1:
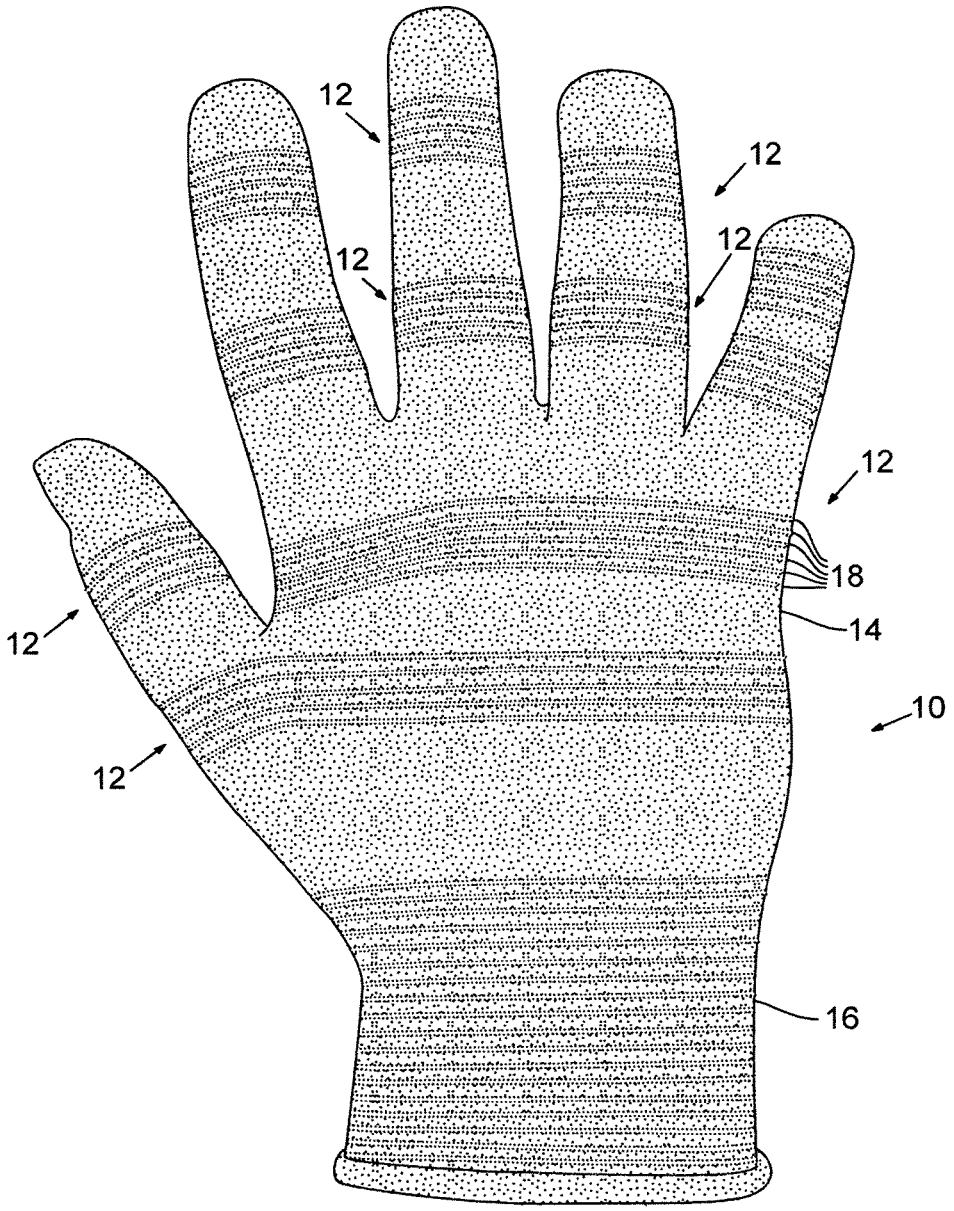
FIG. 1 is a view showing the glove of the invention as worn on a hand.

FIG. 1 shows a glove 10 of knit construction according to the principles of the invention, with knit courses extending laterally across and around the glove, i.e. the courses are generally perpendicular to the extended fingers. This image shows a different pattern at knuckle joint locations 12 and at a bending region 14 that bends with the top knuckles, as opposed the knit pattern at other locations in the glove. The glove includes a cuff 16 surrounding the wrist area. This region also has a different knit construction than that used in most areas of the glove, and it can be different from the construction used at the knuckle joints, with different material content.

It can be seen in FIG. 1 that at each joint or knuckle there are a plurality of visible lines or channels 18 where the bulk of the knit is reduced, to facilitate relatively free bending at the joint. These are special knitting courses and can be called "channels".

Figure 2:
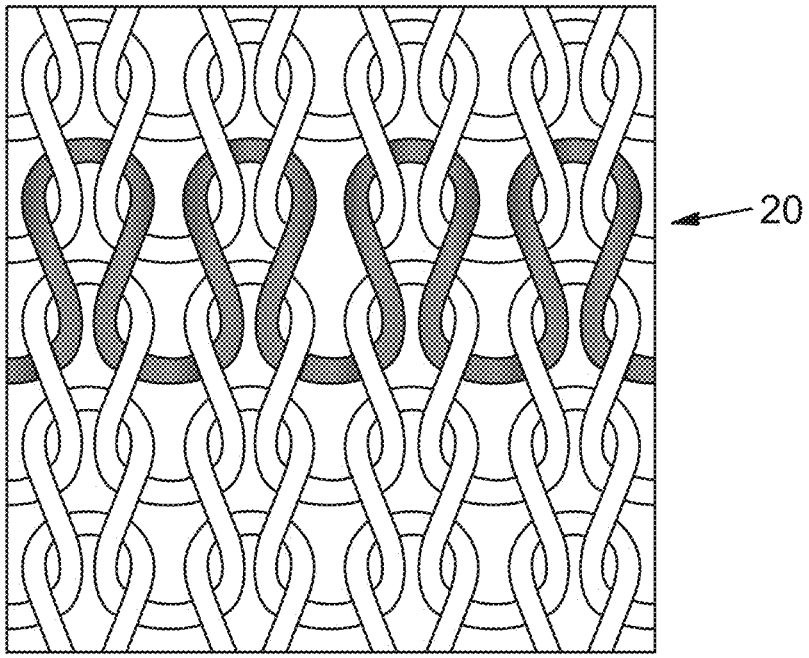
FIG. 2 is a schematic plan view showing a standard weft knit construction used in the textile industry.

FIG. 2 shows an industry standard. Such a knitting structure is well known and very common. All stitches in this example are knit stitches, not alternating with purl stitches. For the invention weft knitting is used, although knit stitching or a combination of knit and purl stitching can form the knitted structure.

Figure 3:
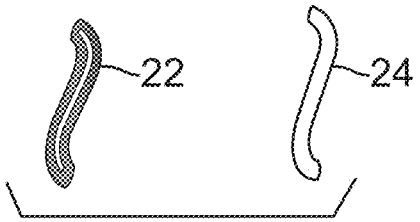
FIG. 3 is a schematic drawing showing the types of feeders used in the knit construction of the invention.

FIG. 3 schematically indicates two different feeder yarns used with the invention. These are examples, the important structural feature being that the knitting yarn in certain courses is lighter and of lower profile, with the remaining courses using yarn considerably heavier and bulkier. Here, one feeder is heavier and bulkier than the other, but the important thing is that at joints of the hand courses are made with a less bulky yarn than in the field (essentially all other locations). In this example two different feeder yarns are used, one of these alone in the channel courses 18, and the two feeder yarns together in the field to produce a much greater bulk. In this case the first feeder yarn 22 is a less bulky feeder and can be made up, for example, of three strands of nylon yarn. The second feeder yarn 24, at the right in the drawing, may be heavier in bulk and can be made up, for example, of one strand of nylon and one strand of cotton. It is the second feeder 24 that is used in the channels 18 that provide flexibility in the glove.

Although the two feeders together produce a much greater bulk than one alone, the second nonetheless has sufficient strength in the channels, where used alone. In one example, the all-nylon first feeder 22 is a three-strand nylon filament yarn. Each of the three strands comprises two strands of 24 filament/78 Denier nylon filament fiber twisted together. This can be denoted as 3x78D/2/24. The nylon filament fibers are very small, and in this example the first feeder 22 has a diameter of about 0.08 mm. The second feeder yarn 24 of this example can be denoted 1x21s cotton yarn plus 1x78D/2/24 nylon filament yarn. In other words, feeder two comprises one strand of 21 singles cotton yarn plus one nylon composite strand which comprises two strands of 24 filament/78 Denier nylon filament fiber. The diameter of the cotton/nylon feeder 24 is about 0.16 to 0.17 mm. Thus, in this example the cotton/nylon second feeder 24 is about twice the diameter of the all-nylon first feeder 22. The total diameter, when the two feeders are used together, is about 0.24 to 0.25 mm. Therefore the bulky field knit has yarn of about 50% greater diameter than the yarn in the channels 18, in this preferred embodiment.

Figure 4:
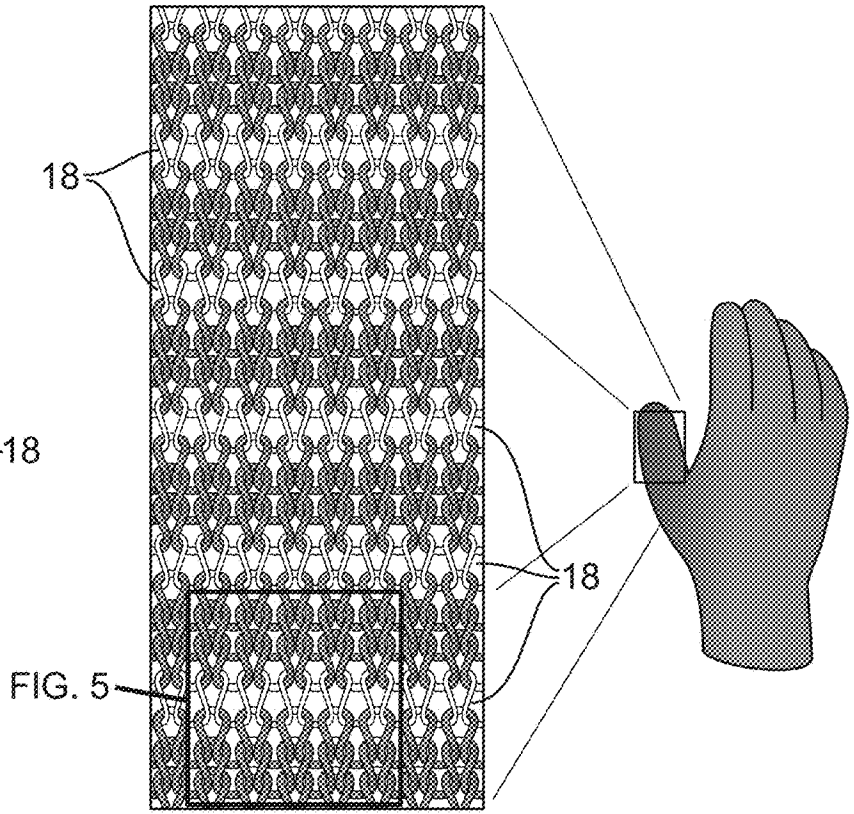
FIG. 4 is a plan view showing a portion of a glove of the invention at a knuckle or other joint.
Figure 5:
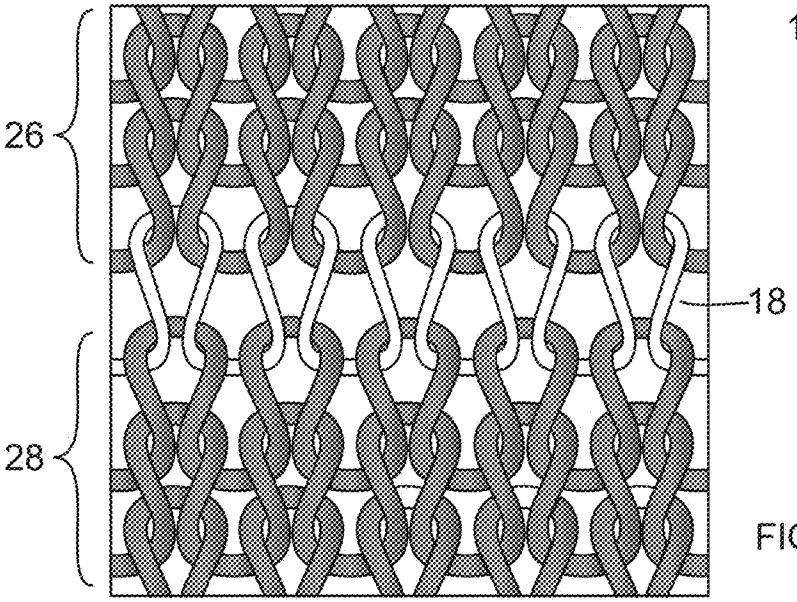
FIG. 5 is an enlarged detail view showing a portion of the knit construction shown in FIG. 4.

FIGS. 4 and 5 illustrate that in normal or field knitting of the glove (where the channels 18 are not present), indicated at 26 and 28 in the enlarged view of FIG. 5, the two feeder yarns are used together, resulting in courses of stitches that have a total of four strands nylon yarn and one cotton yarn. However, in the courses at the channels 18, only the feeder yarn (second feeder) is used, and thus the channel stitches (courses) are made up of a channel yarn that has only one nylon and one cotton yarn (in this example). This produces a flexible, bendable course or channel. In a preferred embodiment the bulk of the field knitting yarn is at least 50% greater than that of the channels 18. In further embodiments the field yarn bulk is at least 75% greater than that of the channels, or at least twice that of the channels. This relationship can be achieved in different ways, the above representing one preferred embodiment.

FIG. 4 shows a portion of a knuckle joint area of the glove. In a preferred embodiment this area includes five parallel channels 18, with preferably three knit courses between adjacent channels. These five parallel courses or channels 18 provide the needed flexibility at the knuckle joints and across the palm. It should be understood, however, that a different number of channels could be used at each knuckle (such as three, four or six), and a different number of regular field courses can be positioned between adjacent channels (such as one, two, or four).

Further, different feeder yarns can be used, the important consideration being that the feeder yarn 24 be sufficiently strong but less bulky than the combination of yarns used in the normal knitted areas of the glove, i.e. the regions 26 and 28 shown in FIG. 5. It is not necessary that the yarn in the regions 26 and 28 be a combination of the feeder yarn 24 and another yarn, but only, as discussed above, that the yarn used in the normal knitting courses be considerably heavier and bulkier than the second "channel" feeder yarn 24. For example, the normal or field yarn (at 26, 28) could be a doubling of the second feeder yarn.

The result is that ease of bending is provided at the channels, especially with multiple channels extending across each knuckle joint. The reduced bulk of the knuckles allows for better contact with a rope, for enhanced feel, grip and control.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. A roper's glove with flexibility at knuckles to provide for free bending of the glove at joints, comprising:

the glove being of knit construction, with knitting courses extending laterally across and around the glove, the knit construction including normal knitting courses in field areas over most of the glove, as a field knit construction, the knit construction including a series of spaced apart special knitting courses or channels extending across knuckles, such that at a knuckle joint of the glove a plurality of said special knitting courses extend in parallel across the knuckle joint, the normal knitting courses comprising a field yarn which is a heavy, bulky yarn, and the special knitting courses or channels comprising a channel yarn which is substantially lighter and less bulky than the field yarn, such that at knuckles the glove is flexible and freely bending, substantially more flexible than in field areas of the glove, due to the series of channels formed with the channel yarn at knuckles.

2. The roper's glove of claim 1, wherein the series of special knitting courses or channels include at each knuckle joint at least three parallel special knitting courses separated by normal knitting courses.

3. The roper's glove of claim 2, wherein the special knitting courses are separated by at least two normal knitting courses.

4. The roper's glove of claim 2, wherein the special knitting courses are separated by at least three normal knitting courses.

5. The roper's glove of claim 2, wherein the series of special knitting courses at each knuckle joint include at least four special knitting courses.

6. The roper's glove of claim 2, wherein the series of special knitting courses at each knuckle joint include at least five special knitting courses.

7. The roper's glove of claim 1, wherein the field yarn has a diameter at least about 50% larger than the channel yarn's diameter.

8. The roper's glove of claim 1, wherein the field yarn has a diameter at least about 75% larger than the channel yarn's diameter.

9. The roper's glove of claim 1, wherein the field yarn has a diameter at least twice the channel yarn's diameter.

10. The roper's glove of claim 1, wherein the field yarn is made up a first feeder yarn combined with a second feeder yarn, and wherein the channel yarn is formed of only the second feeder yarn.

11. The roper's glove of claim 10, wherein the field yarn includes three strands of nylon yarn, and the second feeder yarn includes one strand of nylon yarn and one strand of cotton yarn.

12. The roper's glove of claim 11, wherein the first feeder yarn comprises 3x78D/2/24 nylon filament yarn, and the second feeder yarn comprises 1x21s cotton yarn plus 1x78D/2/24 nylon filament yarn.

* * * * *